United States Patent [19]

Kun

[11] 4,024,623

[45] May 24, 1977

[54] MANUFACTURE OF ISOSTRESS CONTOURED DIES

[75] Inventor: Leslie Charles Kun, Williamsville, N.Y.

[73] Assignee: Union Carbide Corporation, New York, N.Y.

[22] Filed: Nov. 24, 1975

[21] Appl. No.: 634,652

Related U.S. Application Data

[60] Continuation-in-part of Ser. No. 372,339, June 21, 1973, Pat. No. 3,924,441, Division of Ser. No. 189,659, Oct. 15, 1971, Pat. No. 3,757,856.

[52] U.S. Cl. ..... 29/421 R; 29/400 M; 29/527.1; 29/558; 76/107 R; 164/7; 264/219; 264/313

[51] Int. Cl.[2] ..... B23P 17/04

[58] Field of Search ..... 29/400 M, 421 R, 157.3 D, 29/527.1, 527.2, 557, 558, 527.3; 264/219, 90, 101, 220, 313, 316; 76/107 R, DIG. 3; 164/6, 7; 425/388

[56] References Cited

UNITED STATES PATENTS

| | | | |
|---|---|---|---|
| 3,540,315 | 11/1970 | Freitag | 76/107 R |
| 3,550,479 | 12/1970 | Pfaff, Jr. | 76/107 R |
| 3,632,695 | 1/1972 | Howell | 264/219 X |
| 3,638,474 | 2/1972 | Hannaford | 76/107 R X- |

*Primary Examiner*—Victor A. DiPalma
*Attorney, Agent, or Firm*—John C. Le Fever

[57] ABSTRACT

Method for making isostress contoured dies by providing a cavity containing multiple vertical supports. A flexible material is tensionally secured across the top of the cavity to contact the supports and pneumatically deformed to assume an isostress contour. A form setting material is deposited and cured against the isostress contoured flexible material. The cured material may then be used directly as a die or as a die-forming master pattern.

12 Claims, 22 Drawing Figures

STRESS VS SURFACE HEIGHT OF ISOSTRESS CONTOURS
IN 0.007 INCH THICK ALUMINUM

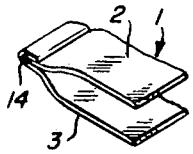
FIG. 5A.
FIG. 5
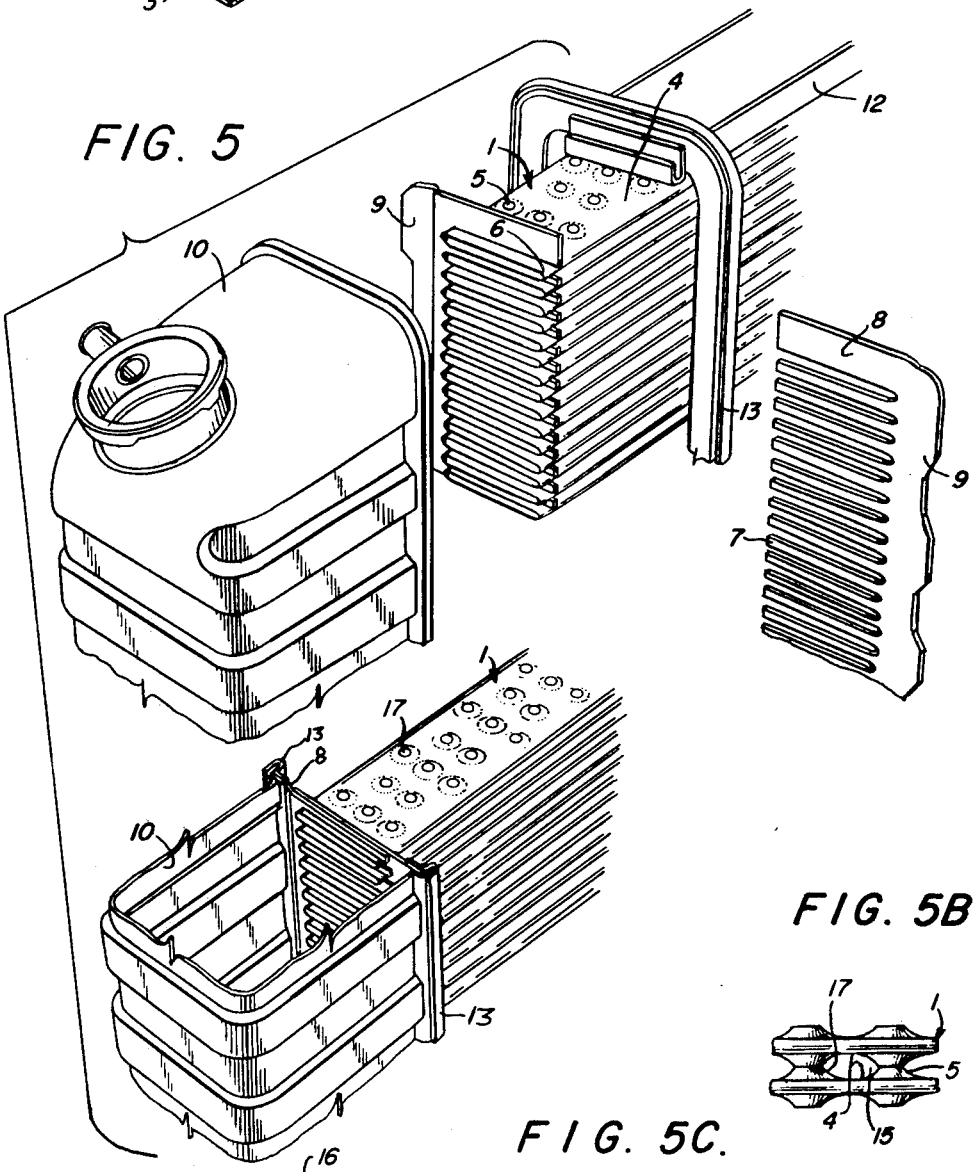
FIG. 5B
FIG. 5C.
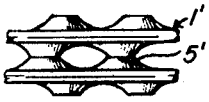
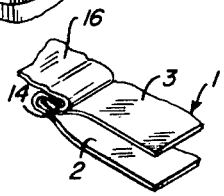
FIG. 5D.

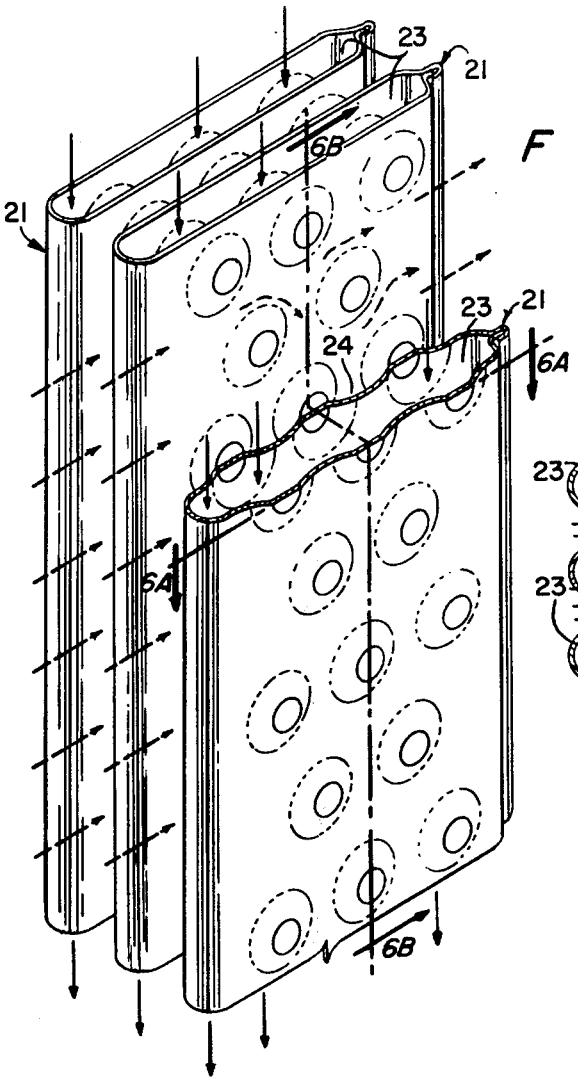
FIG. 6.
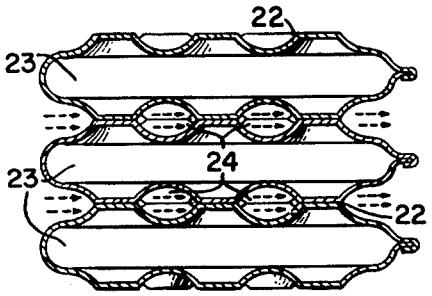
FIG. 6A.
FIG. 6B.
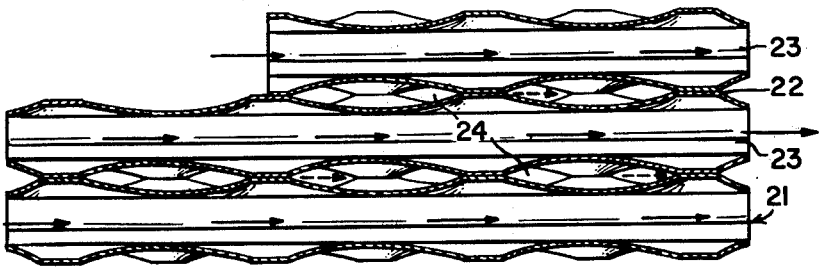

MANUFACTURE OF ISOSTRESS CONTOURED DIES

CROSS-REFERENCE TO RELATED APPLICATION

This application is a continuation-in-part of Ser. No. 372,339 filed June 21, 1973 in the name of Leslie C. Kun and issued Dec. 9, 1975 as U.S. Pat. No. 3,924,441, which in turn is a division of Serial No. 189,659 filed October 15, 1971 in the name of Leslie C. Kun and issued September 11, 1973 as U.S. PaT. No. 3,757,856.

FIELD OF THE INVENTION

This invention relates to a method for making dies having an isostress contoured surface with spaced apart unidirectional projections, for use in fabricating isostress contoured sheets such as may be processed to form thin metal or plastic plate heat exchange channel elements.

BACKGROUND OF THE INVENTION

The need for light weight, inexpensive heat exchange elements for various heat transfer applications has been in demand by industry for a long time. The automobile industry has constantly been searching for a compact, light weight radiator for use in cooling the internal combustion engine. Various types and styles of radiators have been designed, such as the individually finned round tubes, the hexagon-shaped air tubes with water passages between the tubes, and the flat dimpled water passages with air flow therebetween. The pre-1942 automobile engines were designed to deliver between 50 and 125 horsepower and required radiators operable close to atmospheric pressure. A simple solder joined finned-copper constructed radiator was therefore sufficient to cool the low horsepower engine of the automobile without much of a threat of overheating. Various cooper radiators having cup-like or frustroconical surface projections have been designed during this pre-1942 period but the finned copper radiator proved more successful and suitable for automobile applications.

The automobile industry, however, in the post-1945 era embarked upon the design of higher power rated engines while simultaneously attempting to compact them as much as possible. This dual design approach coupled to the employment of improved lubricants resulted in an internal combustion engine capable of operating at high permissible temperatures. To satisfy the heat transfer requirements of such compact high power rated engines and to avoid loss of coolant, the tube and fin cooper radiators were designed to operate under pressure so as to increase the boiling temperature of the coolant. However, within the last several years, additional power operated equipment, such as air conditioners and the like, was added to the automobile thereby further increasing the demands on the internal combustion engine and consequently the duty of the heat rejection system. This has necessitated the designing of present day radiators to operate at pressures as high as 15 psig to prevent coolant loss and overheating. The operating temperature of the automobile engine is anticipated to rise further in the near future thereby necessitating a heat transfer system operable with existing coolants under still higher pressure conditions. The conventional type finned-copper radiator will not perform satisfactorily in an increased temperature environment due to the low stress characteristics inherent in soft solder at high temperatures, such solder being the securing medium between the tubes and fins of the radiator. In addition, the steady increase in the price of copper is causing copper to become an undesirable material for radiator applications from an economical standpoint.

An alternate solution to the conventional type finned-copper radiators for heat transfer applications in the automobile, is to replace the soft soldered copper fins with aluminum fins. Although aluminum is less expensive than copper, the fusion bonding of aluminum fins to the tubes of a conventional radiator by brazing techniques is expensive. In addition, if a corrosive flux is used, the deposits left by the salt bath of the brazing process must me meticulously removed. Alternate brazing techniques and methods, i.e., vacuum brazing, are still in the experimental stage and when perfected their high cost will probably overwhelm the savings otherwise gained in the use of aluminum rather than copper for producing automobile radiators. Other proposals have been advanced, such as the use of adhesive bonding between the fins and tubes of a radiator. However, the low thermal conductivity of present day adhesives renders this approach inefficient for radiator applications.

In heat exchange applications requiring pressure-bearing walls as the primary heat exchange surface, the present invention enables such walls to be fabricated from thinner thermally conductive material than is presently required of conventional type primary heat exchangers. In order to utilize relatively thin sheet materials, the walls of conventional type primary heat exchangers have to be stayed by means of numerous support members so as to reduce stress in the walls. However, stayed walls are normally not practical because of the following reasons:

a. high stress concentrations are still produced in the wall at the point of attachment of the stays;

b. a substantial amount of material is required in the stays, and in heat exchangers such stays contribute only indirectly if at all to heat transfer; and c. the numerous stays are tedious and expensive to install, particularly in heat exchangers where the spacing between walls is very small and often inaccessible.

The present invention overcomes the above drawbacks by providing an isostress contoured heat exchange surface which upon being subjected to a differential pressure across its wall will result in a substantially uniform fiber stress distribution in the wall. This uniform stress distribution substantially eleminates stress concentration points in the wall of a heat excange element thereby permitting the element to be fabricated from rather thin sheets of thermally conductive material.

Another approach to the elimination of stayed walls in primary surface heat exchangers is disclosed in U.S. application Ser. No. 189,509 titled "Primary Surface Heat Exchanger," filed Oct. 15, 1971 in the names of L. C. Kun and J. B. Wulf and issued Sept. 11, 1973 as U.S. Pat. No. 3,757,855, which relates to dimensionally sized and spaced truncated-conical projections in thermally conductive walls.

The present invention is directed to a method of making a die suitable for use in manufacturing an all-purpose, primary-surface heat exchange channelized element having on at least a portion of its surface isostress contours with substantially uniformly disposed unidirectional wall-supporting projections. The heat exchange element is economical to fabricate and when employed in stacked units, they are admirably suited as a heat exchanger for use with internal combustion engines.

SUMMARY OF THE INVENTION

This invention relates to a method for making a die for use in fabricating isostress contoured sheets wherein the die has an isostress contoured surface with spaced apart unidirectional projections. The method comprises fabricating a block having on its surface multiple vertically projected supports and upwardly extending sides around the edges of the block so as to provide a cavity which contains the vertical supports. These supports form a pattern and are dimensionally sized to correlate to the pattern and size of the wall-supporting projections desired in an isostress contoured surface. A flexible material is tensionally secured across the top of the cavity so that it contacts, and is supported by, the vertically projected supports. The flexible material is pneumatically deformed so as to force the unsupported portion of the flexible material into the cavity while the vertically projected supports prevent deflection of the supported portion of the flexible material contacting the supports thereby causing the flexible material to assume an isostress contour having substantially uniformly disposed unidirectional projections. A form setting material is deposited and cured against the pneumatically deformed flexible material. The pneumatic deformation is discontinued and the cured material is removed having an isostress contoured surface with spaced apart unidirectional projections.

The cured material produced by the above-described method may subsequently be used directly as a die or as a die-forming master pattern. In a particularly preferred embodiment of the invention, the cured material is used as a die-forming master pattern to make a metal die. In this embodiment, a tracing milling machine is provided having a tracing stylus adapted for traversing movement and mechanically linked to a milling head for translation of the milling head in response to the traversing movement of the tracing stylus. A metal die blank is also provided and fixedly proximately mounted beneath the milling head, and the removed cured material produced in the aforedescribed method is fixedly proximately mounted beneath the tracing stylus. The tracing stylus continuously traversingly moves across the fixedly mounted cured material so as to trace the isostress contoured surface thereof. The traversing movement of the stylus is transmitted across the fixedly mounted cured material to the milling head through the mechanial linkage, thereby translating the milling head in response to the translation of the stylus, and an isostress contoured surface is milled into the metal die blank to form the metal die. This method is particularly suitable for forming mass production metal dies, of either a flat-bed or a roll-form type.

As used herein, the term "pneumatically deformed" and "pneumatically deforming" are to be understood as including all suitable methods of subjecting the tensionally secured flexible material to a fluid pressure or to pressure transmittd through a semi-fluid or an elastic solid (high density, low modulus) medium, e.g., polybutadiene, whereby a substantially uniform pressure differential is applied across the flexible material to displace the unsupported portion thereof into the cavity for the formation of the aforementioned isostress contour. In practice, it is particularly preferred to carry out the pneumatic deforming step by reducing the pressure in the cavity by partial evacuation thereof so that a pressure differential is created across the flexible material between the atmospheric or ambient pressure acting on the exterior surface of the flexible material and the lower internal cavity pressure acting on the interior surface of the flexible material facing the cavity, as described more fully hereinafter.

DESCRIPTION OF THE DRAWINGS

FIG. 4A — Truncated cone surface.

FIG. 5 — Isometric view of an automobile radiator employing the heat exchange elements of this invention.

FIG. 5A — View taken of the longitudinal edges of a heat exchange element of FIG. 5.

FIG. 5B — Side view of elements 1 of FIG. 5.

FIG. 5C — Alternate embodiment of elements 1 of FIG. 5.

FIG. 5D — Alternate embodiment of the longitudinal edges of elements 1 of FIG. 5.

FIG. 6 — Isometric view of an array of isostress channels with outwardly projected buttons.

FIG. 6A — Cross-sectional view of channels in FIG. 6 taken along line 6A—6A.

FIG. 6B — Sectional side view of channels in FIG. 6 taken along line 6B—6B.

DESCRIPTION OF THE PREFERRED EMBODIMENTS

Figure 1:
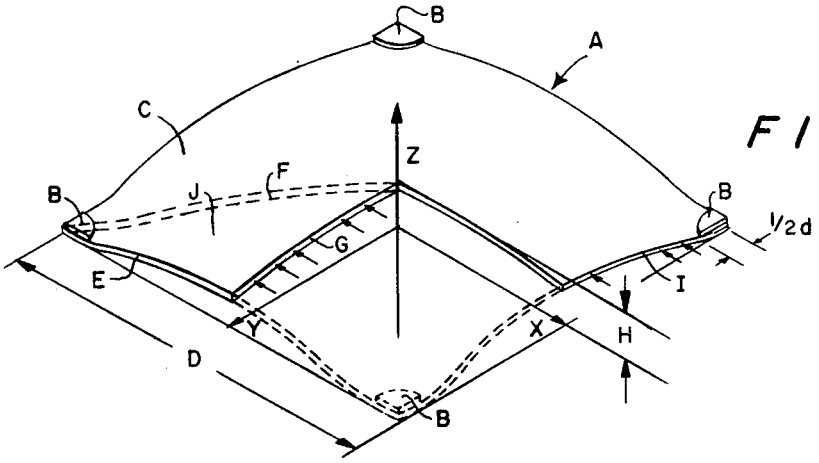
FIG. 1 — Isostress contoured surface.

The isostress contoured dies made by the method of this invention permit the fabrication of isostress contoured sheets such as may be processed to form thin metal or plastic plate heat exchanger channel elements.

A primary-surface heat exchanger may be fabricated from such channel elements, each being formed and bound by at least one thin walled, thermally conductive metal or plastic material, and each having an entrance opening, an exit opening and a multiplicity of isostress contours on a portion of its wall surface with substantially uniformly disposed unidirectional wall-supporting projections formed from the wall in a dimensional relationship to be discussed hereinafter. The wall-supporting projections are arranged so as to mate with and abut against corresponding wall-supporting projections on similar adjacent isostress walls. At least two such channels, when aligned in juxtaposed relationship, will form a heat exchanger having a first set of passages defined by and bound within the conductive walls of each channel, and a second set of passages defined by, and disposed between, the juxtaposed channels so that a first medium can be fed through one set of passages while a second cooler medium can be fed through the other set of passages thereby effecting a heat exchange between the mediums without having the mediums intermix.

The term primary-surface heat exchanger refers to heat exchangers wherein substantially all the material which conducts heat between two media comprises the walls separating the two media. In contrast, secondary surface heat exchangers contain a substantial amount of material in the form of fins which do not separate the media but are contacted on virtually all surfaces by a single medium. In addition, in heat exchange applications wherein a pressure difference exists between the two media of the system, substantially all of the heat exchanger material is stressed pneumatically. Stated another way, primary surface heat exchanger refers to a heat exchanger consisting primarily of plates or sheets and having no separate or additional internal members, such as fins, so that the exchanger is constructed of plates or sheets each side of which is in contact with a different fluid, and heat transfer is substantially and directly between the plates and the fluid.

An isostress surface is a continuously curved surface having a multiplicity of isostress contours wherein each contour has a multiplicity of radii with theoretically no flat segments and resembles the curve contour of a shear-free "soap bubble" membrane. The lack of flat or pointed surface segments substantially eliminates stress concentration points that are present in conventional type dimpled surfaces when such surfaces are subjected to a differential pressure across their surface areas. Thus substantially pure tension or pure compression loading is obtained by utilizing the thin walled isostress contoured channelized element of this invention. Pure tension or pure compression loading of a finite thickness, pressure bearing wall results in the substantially uniformly distribution of fiber stress through the cross-sectional area of the wall parallel to its surface. For stacking or abutting two or more isostress contoured walls together, wall-supporting unidirectional projections are disposed in a pre-aligned space relationship on the surface of each element so that when the walls are juxtaposed, the outer extremities of the wall-supporting projections, hereafter referred to as buttons, will be in touching relationship. With reference to any adjacent pair of pressure withholding walls, wherein the buttons of both walls project inward into the space between the walls, the forces due to the pressure either external or internal of the pair will be substantially balanced, i.e., the secured contact between the buttons will sustain by tension or compression the entire force due to the pressure and no other structural member will be needed to absorb the load. Thus pressure force will be counter-balanced by a restraining force developed within the pair of walls without the necessity of any external structure.

With reference to any adjacent pair of pressure withholding walls, wherein the buttons of both walls project outward from the space between the walls, the pressure either external or internal of the pair will not be balanced and a member external of tne pair will be needed on each exposed face of the pair to absorb the load by supportive contact with the buttons in either tension or compression. Thus a restraining force will not be developed within the pair of walls to counterbalance the pressure force. In a series, stack or array of walls, the member external of the pair may be yet another isostress contoured wall with buttons matching those of the justaposed surface of the pair.

With reference to any series, stack or array of isostress contour, pressure withholding walls wherein the buttons of the two outermost walls of the stack project inward toward the stack, the forces due to pressure will be substantially balanced throughout the stack and no other structural member will be needed to absorb the pressure load and to restrain the walls from deflecting outward from the stack.

With reference to any series, stack or array of isostress contour, pressure withholding walls wherein the buttons of the two outermost walls of the stack project outward from the stack, the forces due to pressure will not be balanced within the stack and a structural member will be needed juxtaposed in supportive contact with the buttons of each outermost wall to absorb the pressure load and restrain the stack.

Since the isostress contoured channel is designed as a primary-surface heat exchange channel, its wall material need not be highly conductive and thus can be selected from at least one of the groups consisting of metals, metal alloys metal clads, plastics (such as Mylar), plastic-coated metals and the like. The criteria of the material selected for the heat exchange isostress channel is that it be only sufficiently thermally conductive so that as a hot medium is passed through the channel, the heat of the medium will be conducted through the wall of the channel to a cooler medium external of, and adjacent to, the channel which can absorb the heat thereby successfully effecting a heat transfer between the mediums without intermixing of said mediums. Materials such as aluminum, copper, steel, brass, titanium and Mylar are suitable for this application.

"Substantially uniformly disposed wall-supporting projections" is intended to be broad enough to include a pattern of wall-supporting projections having a progressive variation in spacing along at least one axis of the heat exchange element. In addition, as hereinafter stated, additional wall-supporting projections can be provided along the curved portion of the channel which may have a spacing relationship different from that of wall-supporting projections occupying the central portion of the heat exchanger element.

The dimensions of, and the dimensional relationship between, the wall-supporting projected buttons on the isostress contoured surface are somewhat restrictive depending on the end use environment of the heat exchange channel. The pattern of wall-supporting projected buttons can be arranged in a square, diamond, triangle or any other design configuration depending somewhat on the actual shape of the channel and the intended differential pressure to which the wall of the channel will be subjected in its intended environment. To minimize the resistance to flow and maximize the heat transfer effectiveness of any defined flow area of a heat exchange channel, the wall-supporting projected buttons of selected shape should be designed and arranged in only such size, number and pattern as will provide the restraint necessary to withstand the maximum differential pressure for which the channel wall is designed in its intended environment. Once the desired size and pattern of the wall-supporting projected buttons are determined, the isostress contoured surface, necessary for maximum heat transfer in an intended end use pressurized environment, can be imparted to the surface of a thin-walled thermally conductive sheet of material along with the wall-supporting projected button contours by any conventional technique such as pressing, stamping, rolling or the like.

A thermally conductive isostress contoured, wall-supporting button projected sheet, so prepared, can be longitudinally folded upon itself with the projected buttons facing either inwardly or outwardly, and the folded sheet segments spaced sufficiently apart so as to define a passage therebetween. When the buttons project inwardly of the passage, they should match and contact with buttons extending inwardly across the passage from the opposite wall. The width of the passage so formed is thereby defined by the projected heights of the wall-supporting buttons. Since stress concentration may occur at the bending area of the sheet in its intended operational environment, additional wall-supporting projects may be disposed within the vicinity of such areas so as to equalize the stresses throughout the channel structure. The longitudinally mating edges of the sheet can then be suitably sealed by conventional techniques, i.e., soldering, brazing, welding or with an adhesive filled lock-seam joint, to make it leak-tight. This isostress contoured, unidirectional wall-supporting button projected channel is then ready for use as a heat exchange element. When an isostress channel is formed with buttons projecting inwardly and when intended for internal pressurization, then the button contacting surfaces within the passages should be bonded together by conventional means as soldering, brazing or with an adhesive. An array of channels so formed with the wall-supporting projected buttons in touching relationship, can then be appropriately assembled to produce a compact, efficient primary-surface heat exchanger. When the wall-supporting projected buttons are disposed outwardly, then the channels can be superimposed in button touching relationship wherein the heights of the projected buttons will define the size of the passage between adjacent channels. When the wall-supporting projected buttons are disposed inwardly, then the channels will have to be spaced apart by some additional means so as to define a passage between adjacent channels. A pressurized medium, such as hot water, could then be passed through the channels while a coolant medium, such as cool air, could be passed between, and contact the outer surface of, the channels thereby effecting a transfer of heat between the mediums. The isostress contoured, wall-supporting button projected sheet could also be fabricated into a circular or spiral channel, or any multiple sided channel by appropriate bending and/or folding techniques. The heat exchange cannelized elements so formed can also be shaped into any curvilinear configuration and then superimposed one on the other leaving defined passages therebetween to form a simple or complex geometry heat exchanger having multiple confined channelized passages and multiple separate passages defined by, and between, the outer surfaces of adjacent heat exchange channelized elements. By passing a medium through the channelized passages while directing a second coolant medium through the passages defined by, and between, the outer surfaces of adjacent elements, an effective, large, primary-surface heat exchanger is obtained. In a cross-flow heat exchange operational mode, the heat exchanger of this invention will provide a low frontal area and a low external fluid pressure drop. Frontal area is the area of the projection of the entire array of heat exchange channels onto a plane normal to the direction of fluid flow through the channelized passages. Low external fluid pressure drop is the static pressure drop across the length of the flow path of the external coolant medium.

The mediums can be fed through their respective passages in a mutually parallel relationship, a perpendicular relationship or at any angle relationship therebetween.

An isostress contoured surface segment A is shown in FIG. 1 and resembles the contour of a shear-free soap-bubble membrane. the soap bubble membrane shape was closely approached by using a thin, flexible, elastic film of a rubber-like material. Members B were utilized to secure the edges of the square segment A to a horizontal plane, defined as the X-Y plane, while the area C, defined as the area contained within the square bound by the B supports, was subject to a hydrostatic pressure to form an isostress contour having a height dimension H measured along the Z axis from the X-Y plane at the coordinate intersection of X=0, Y=0. Subjecting a thin structure, having an isostress contour as shown in FIG. 1, to a differential pressure across its wall area C will result in imparting substantially pure tension or pure compression to the wall void of any appreciable shear or bending forces thereto, i.e., pure tension or pure compression results in uniform distribution of fiber stress in the cross-sectional area I of wall A parallel to its surface area C as shown by the arrows in FIG. 1. Thus a thin membrane having an isostress contour can withstand greater differential pressure without deforming or rupturing than a non-isostress membrane of identical size and thickness. An isostress contoured wall can be fabricated using the following equation which is developed for an ideal shear-free, soap bubble membrane. The equation relates the externally applied force $\Delta P$ and the internal resistance $\sigma$ to the contour of the bubble expressed in terms of $dZ/dX$ and $dZ/dY$ as follows:

$$\frac{\Delta P}{\sigma} = \frac{\left[1+\left(\frac{dZ}{dY}\right)^2\right]\frac{d^2Z}{dX^2} - 2\frac{dZ}{dX}\,\frac{dZ}{dY}\,\frac{d^2Z}{dXdY} + \left[1+\left(\frac{dZ}{dX}\right)^2\right]\frac{d^2Z}{dY^2}}{\left[1+\left(\frac{dz}{dX}\right)^2+\left(\frac{dZ}{dY}\right)^2\right]^{3/2}} \quad \text{(A)}$$

wherein:

$\Delta P$ = differential pressure across the membrane wall of the surface (e.g. lb/in$^2$).

$\sigma$ = surface tension of the ideal shear-free soap-bubble membrane (e.g. lb/in). $dZ/dX$ and $dZ/dY$ = the partial derivatives of the surface function Z(X,Y) with respect to the coordinates X and Y.

The foregoing equation A can be used to design an isostress contoured wall by assuming $\sigma = St$ where S is the fiber stress developed in a thin material of finite thickness $t$ when subjected to a pneumatic pressure difference $\Delta P$ across the wall. Solution of the equation depends upon defining known conditions existent along the boundaries of a typical symmetrical segment of the curved area contained within the repetitive pattern of supports, such typical symmetrical segment being chosen such that its boundary conditions are known. The segment should be as small as symmetry will permit in order to simplify computation. It should be noted that equation A is applicable for any pattern of supports as long as the typical symmetrical segment is chosen to suit the specific pattern employed such that the conditions at the boundaries of such symmetrical segment are known. In general, the partial derivative of the normal to any edge of a symmetrical segment with respect to an axis perpendicular to the plane containing the support points is zero. Thus the slope at the boundary edges of a symmetrical segment with respect to the plane containing the supports is zero which indicates no vertical component of force.

For a square pattern of supports B as shown in FIG. 1, the smallest typical symmetrical segment of the area A is triangle J defined by edges E, F and G. Triangle J is a symmetrical segment because area A contains eight such identical triangles. Thus knowing the boundary conditions of the smallest repeatable segment of an area will simplify the solution of equation A. The tip of the triangle J covered by support B is excluded from the symmetrical segment of the area. Along the edges E, F and G, the partial derivative of Z(X,Y) with respect to the normal to such edges is zero; e.g., $dZ/dN = 0$ where N is any line parallel to the reference plane X-Y and normal to edges E, F and G, respectively, of triangle J.

Now if one assigns values to D, H and $d$, for a specific application, then a value for $(\Delta P)/\sigma$ can be obtained. Recalling the assumption that $\sigma = St$, the designer may select values for two of the terms $\Delta P$, S and $t$ and calculate the other. For example, a square aluminum isostress contoured wall 0.009 inch thick, having a dimension H of 0.030 inch at its center, a D dimension of 0.4 inch and a support B dimension radius of 0.060 inch, was calculated as having a fiber stress S of 4000 lb/in$^2$ when subjected to a pressure differential of 25 lb/in$^2$.

Alternatively, values may be asigned to $\Delta P$, S and $t$ and a solution for H may be rendered in terms of D. This allows the designer to choose between numerous sets of values of D and H to suit fluid flow and heat transfer requirements.

Still another use of the equation is to map the surface contour. Assume that boundary conditions have been established and that values for $\Delta P$, S, $t$, D and H have been assigned. The equation can be solved for an array of X, Y values to obtain corresponding values of Z. This provides a listing of coordinates at numerous points on the surface which can be employed, for example, to produce a forming die.

Truncated cone impressed surfaces, as shown in FIG. 4A, if fabricated from the same material and having the same thickness and size as the 0.4 inch square isostress contoured wall segment above, could not function under a differential pressure of 25 lb/in$^2$ as well as the isostress surface and would be more susceptible to failure due to fatigue loading, fatigue loading being the intermittent loading and unloading of a structure. A thin-walled thermally conductive material, such as aluminum below about 0.02 inch thick, impressed with an isostress contoured surface with wall-supporting unidirectional projections and then formed into a channelized structure will produce a heat exchange element admirably suited for various heat transfer applications such as radiators for internal combustion engines.

A method for making dies having an isostress contoured surface with spaced apart wall-supporting unidirectional projections for use in the fabrication of heat exchange elements would consist basically in fabricating a block having on its surface multiple vertical projection supports forming a pattern and being dimensionally sized to correlate to the pattern and size of the wall-supporting projections desired in an isostress contoured surface. Upwardly extending sides are provided around the edges of the block, thereby producing a recess or cavity which contains the vertical supports. The cavity would be connected to pressurizing means so that when a flexible material is tensionally secured across the top of the cavity and also contacting and supported by the vertical projected supports, the pressurizing means can be operated for pneumatically deforming the flexible material so as to force the unsupported portion of the flexible material into the cavity while the vertical projected supports prevent deflection of the supported portion of the flexible material thereby causing the flexible material to assume an isostress contour having wall-supporting projections. Thereafter a form setting material can be deposited against the pneumatically deformed flexible material and when properly cured, the pressurizing means can be deactivated to discontinue the pneumatic deformation of the flexible material. The cured material having the isostress contoured surface with substantially uniformly disposed unidirectional wall-supporting projections can then be removed and is ready to be used as a die for fabricating isostress contoured sheets which in turn may suitably be employed to fabricate isostress contoured heat exchange elements.

An illustration of this die making method will be described in conjunction with FIGS. 2, 2A, and 2B. A pressure block 21 has openings 22 interconnected to passage 23 which in turn is coupled to vacuum pump 24, bleed valve 25 and manometer 32. Projections 26, spaced to provide the desired pattern of an isostress contoured surface, project a distance from surface 33 which exceeds the maximum height H of the desired isostress contoured surface as illustrated in FIG. 1, such height H being measured vertically from a horizontal plane containing the areas secured under support members B, to the crest of the curve surface located at the diagonal intersection of surface C along the Z axis as shown in FIG. 1. Frame 27 is securely mounted on the periphery of pressure block 21 using screw means 28 and projects above the perimeter of pressure block 21 by an amount substantially equal to the height of projections 26. A flexible membrane 29, such as natural or synthetic rubber, is tensionally stretched onto frame 27 and secured thereat by tack means or the like (not shown). Preferably flexible membrane 29 rests on top of projections 26. A second frame 30, substantially similar to frame 27, is placed on top on frame 27 and is secured to frame 27 at its corners and/or around the entire frame at preselected spacings by screw means 31.

Figure 2:
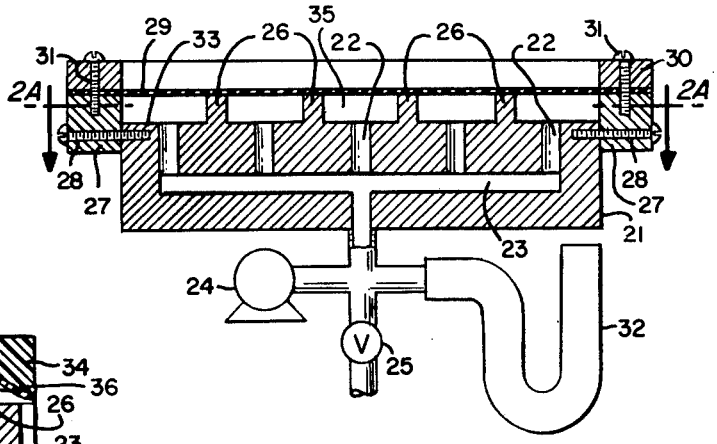
FIG. 2 — Apparatus for forming isostress die or die-forming master pattern.
Figure 2B:
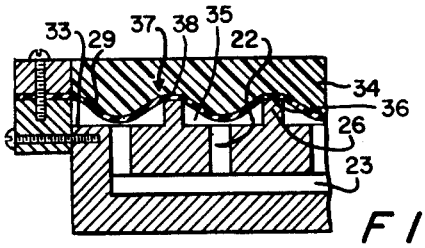
FIG. 2B — Apparatus of FIG. 2 operating with pressurizing means activated.

With flexible membrane 29 air-tightly secured to pressure block 21 via frames 27 and 30, vacuum pump 24 is activated whereupon flexible membrane 29 is suctioned into the openings 35 between projections 26 as shown in FIG. 2B. By regulating the pressure created by vacuum pump 24, as indicated on monometer 32, via bleed valve 25, and isostress contour can be imparted to flexible membrane 29 between projections 26. Projections 26 should be of a sufficient height so as to prevent flexible membrane 29 from deformably touching surface 33 of openings 35. Upon attaining a desired isostresss contour in membrane 29 for a particular intended end use application, a form setting material 34, such as epoxy resins, thermoplastics, concrete, cement or the like, is deposited into frame 30 where it is supported by the flexible membrane 29. Particularly suitable form-setting materials include epoxy resins admixed with fine metal powder fillers such as steel, aluminum, carbide or bronze. After deposition on the membrane 29, the form setting material 34 is then allowed to cure. The horizontal surface 36 of projections 26 impart to flexible membrame 29, and, thus, to form setting material 34, inward projections 37 each having a horizontal button segment 38. Although this horizontal button segment 38 of each inward projection 37 is shown flat, it may be curved, wavy or suitably ridged as long as it is shaped to mate with other button segments on similar type projections spaced on a cooperating isostress contoured surface so that when the surfaces are formed into channels they can be stacked to produce a multi-channel structure. Thereafter, vacuum pump 24 is deactivated, frame 30 is disassembled and the cured form setting material 34 is removed. This isostress contoured surface with wall-supporting projections 37 can then be used as a master cast for the fabrication of a mold or it may be appropriately used as a die with or without a suitable cladding or protective coating. The multiple-curved isostress die fabricated thereby can be employed using conventional techniques to produce isostress contoured surfaces having wall-supporting unidirectional projections in thin sheet material. The sheets can then be processed as described above to yield a desired shaped heat exchange element which when assembled to structurally alike or structurally different heat exchange elements, will produce a primary-surface heat exchanger having excellent heat transfer capabilities.

Figure 2A:
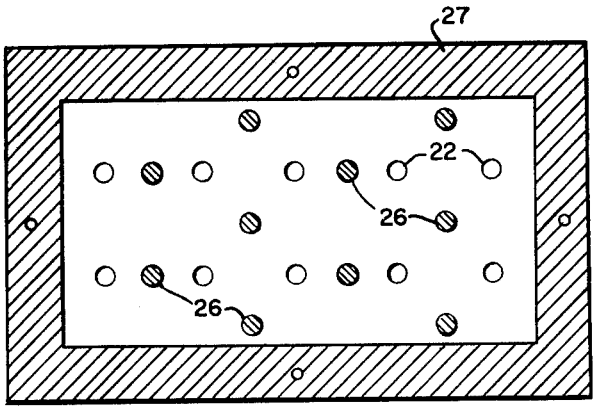
FIG 2A — View taken along line 2A—2A of FIG. 2.
Figure 8:
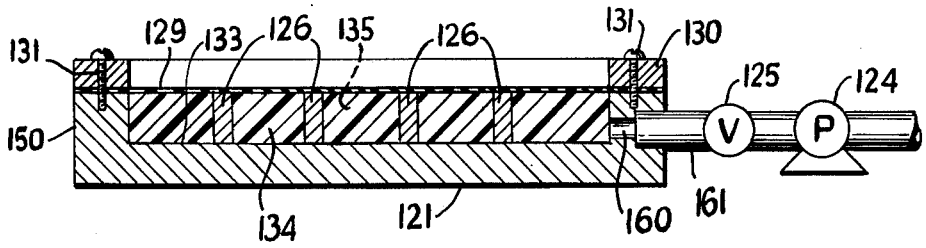
FIG. 8 — Alternate apparatus for forming isostress die or die-forming master pattern.
Figure 8A:
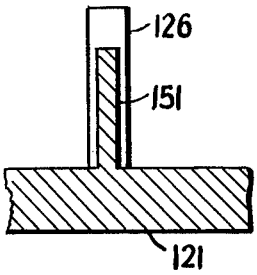
FIG. 8A — Sectional elevational view of projection and support pin assembly of the FIG. 8 apparatus.

Whereas FIGS. 2, 2A and 2B show means for casting the form-setting material on the top side of the flexible material, it is also feasible to cast the formsetting material on the underside of the flexible material. With reference to FIG. 8, a pressure block 121 is provided with projections 126 and with a passage 160 to which a fluid withdrawal conduit 161 is suitably joined as shown. Fluid withdrawal conduit 152 has value 152 disposed therein upstream of the suction pump fluid withdrawal means 124. Projections 126, as before, are spaced to provide the desired pattern of an isostress contoured surface and project a distance from surface 133 which exceeds the maximum height H of the desired isostress contoured surface as illustrated in FIG. 1, such height H being measured vertically from a horizontal plane containing the areas secured under support members B, to the crest of the curve surface located at the diagonal intersection of surface C along the Z axis as shown in FIG. 1. The upwardly extending sides 150 at the edges of pressure block 121 which form the cavity containing the vertical supports 126 have a vertical height measured from surface 133 which is substantially equal to the height of the projections 126. As shown in FIG. 8A, the projections 126 in this embodiment are separable from pressure block 121, being vertically slidably fitted over the fixed support pins 151 which are securely attached, as by welding to the pressure block. In this manner, the projections 126 are removed at the end of the forming operation and remain as integral parts of the final die or pattern. When the finished article is to be used directly as a die, it may be advantageous to provide projections 126 in the form of a hard wear-resistant metal such as steel.

In the actual forming sequence using the above-described system, the cavity within the pressure block is completely filled with a curable form-setting material in the liquid state such as steel-powder-filled epoxy resin, with admixed hardener. A flexible material 129 is then tensionally stretched across the top of the filled cavity, taking care that all air pockets are excluded, i.e., that there are no voids in the form-setting material covered by the flexible material, and thereafter secured at the top surface of the upwardly extending sides of the pressure block by tacks or other fastener means (not shown). Preferably flexible membrane 129 on top of the projections 126. A frame 130 is then placed on top of the sides 150 of pressure block 121 and secured thereto at its corners and/or around the entire pressure block at preselected spacings by screw means 131.

Figure 8B:
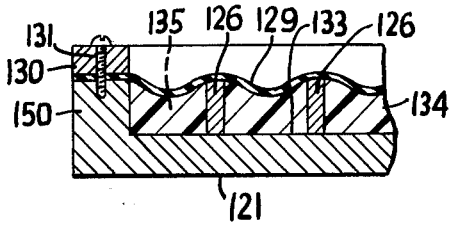
FIG. 8B – Apparatus of FIG. 8 operating with pressurizing means activated.

With flexible material 129 air-tightly secured to pressure block 121 via frame 130, suction pump 124 is activated to remove a part of the form-setting material from the cavity by means of passage 160 and fluid withdrawal conduit 161 so that the flexible material 129 is pneumatically deformed, being depressed into the openings 135 between projections 126 by the external pressure on the top exposed surface of the material, as shown in FIG. 8B. By regulating the pressure differential across the material created by suction pump 124, an isostress contour can be imparted to flexible material 129 between projections 126, and when the desired contour is obtained, fluid removal is terminated by closing valve 125 and the form-setting material remaining in the cavity is allowed to harden against the underside of the flexible material 129. Projections 126 should again be of a sufficient height so as to prevent flexible material 129 from deformably touching surface 133 of openings 135.

After the form-setting material is sufficiently cured, the pneumatic deformation of the flexible material is discontinued by deactivation of suction pump 124, frame 130 is disassembled and the cured form-setting material 134 is removed. Parting sheets or a suitable release coating may be used if desired to facilitate removal of the membrane and removal of the cured material from the pressure block.

As mentioned earlier herein, the cured isostress contoured form-setting material may be used as a master cast for the fabrication of a mold or it may be appropriately used as a die. The direct use of the cured form-setting material as a die may be accomplished in several ways. For example, the form producing directly on the flexible material in the FIG. 2 system is a female die. A second, male die can be cast over the female die with suitable spacer and parting material provided therebetween. The resultant male and female dies are then suitable for use in stamping isostress contoured sheets. Alternatively, the form produced directly on the flexible material may be preserved as a master pattern in order to insure that numerous dies produced therefrom will uniformly diplicate precisely the same contour. In this case, the male die is cast from the female master pattern (formed by the system illustrated in FIGS. 2, 2A and 2B) and a second-generation female die is cast from the male die.

The direct use of the cured, form-setting material produced in the aforedescribed manner as a die in conjunction with a corresponding mating die cast therefrom has proven extremely satisfactory in practice for stamping an isostress contour into thin, e.g., 8 mil, aluminum sheets. For producing isostress contoured sheets from thin, easily-formed sheet metal, it is also possible to employ only a male die, and to impress the sheet metal between the die and a compressible, resilient support such as a pad of polyurethane rubber.

For mass production of heat exchange elements, a die may be desired which is more durable than those produced from the aforementioned form-setting materials. A metal die may be produced by using the cured form-setting material described hereinabove as a master pattern for impressing the desired contour in a clay mold. The production die is then cast in the mold. A suitable casting metal is magnesium-doped cast iron. It is evident that both male and female metal dies may be made in this manner having common origin in a pneumatically formed master pattern. For example, a cured, form-setting female master pattern may be formed as illustratively described in connection with FIGS. 2, 2A and 2B, and a corresponding male pattern may then be cured against the female master pattern. Both patterns are then used to produce separate male and female molds for casting metal dies.

Figure 9:
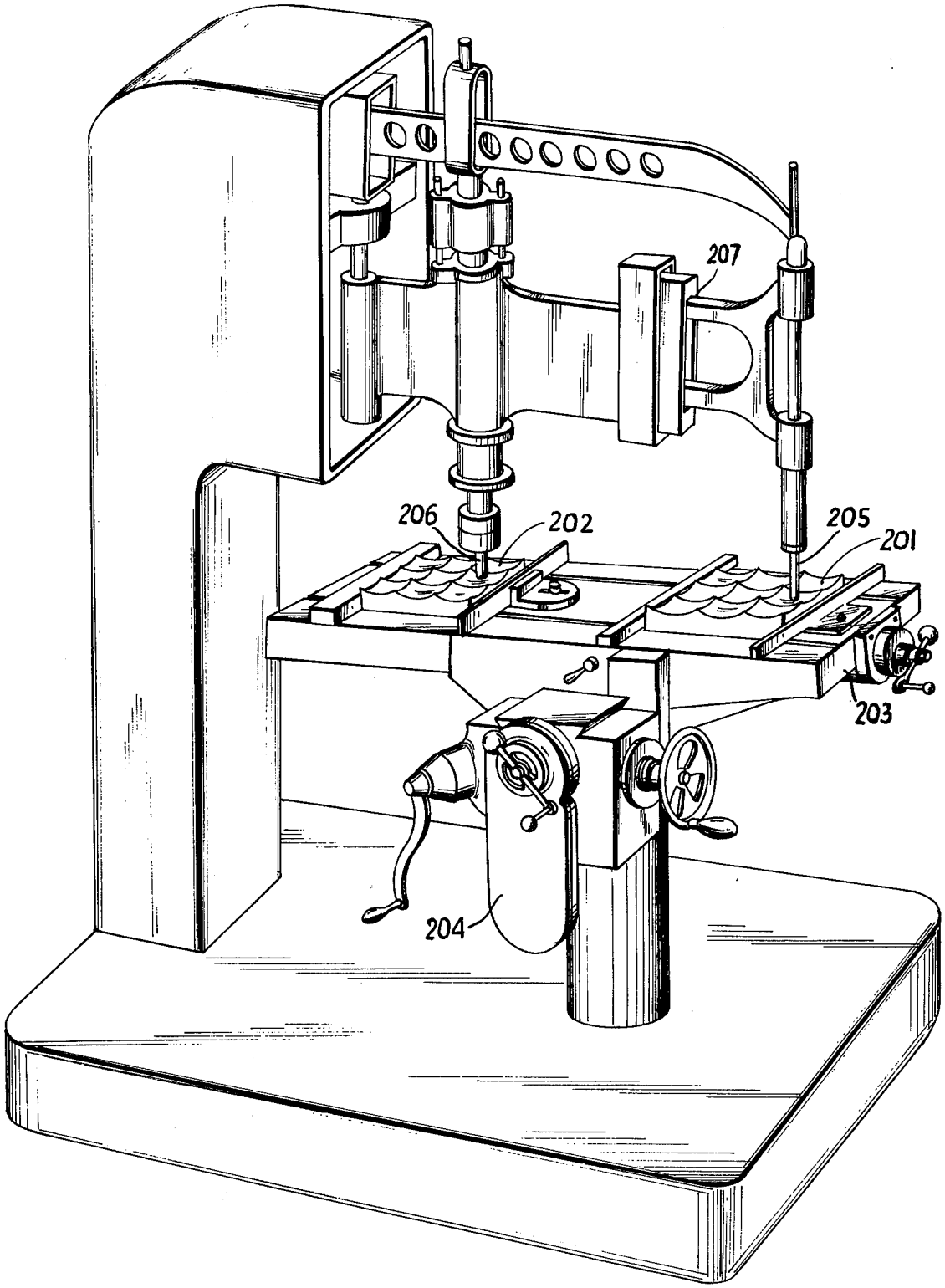
FIG. 9 — Tracing milling machine for forming metal die.

As an alternative to the above-described casting method of forming a mass production metal die from the cured form-setting material master pattern, it is also possible to fabricate a metal die by means of a tracing milling machine arranged, for example, as shown in FIG. 9. By means of the illustrated apparatus, tracing and milling functions are conducted to transfer the isostress contour from the cured form-setting material to the milled die. FIG. 9 represents a generalized schematic diagram of a tracing milling machine of a conventional type such as are widely used in various commercial applications including die sinking, cavity and mold making, and profiling and contouring of metal parts.

In the embodied arrangement, the cured form-setting material master pattern 201, i.e., the cured material removed from the pneumatic forming apparatus of FIG. 2 or FIG. 8, and the metal die blank 202 are each appropriately positioned on the table platform 203 whose attitude, height and length may be suitably set by the control adjustment means 204. The master pattern 201 is fixedly proximately mounted beneath tracing stylus 205 and the metal die blank 202 is fixedly proximately mounted beneath rotatable high speed milling head 206. The tracing stylus 205 is continuously traversingly moved across the master pattern 201 in a conventional manner to trace the isostress contoured surface of the pattern and the movement of the stylus across the pattern is transmitted to the milling head through a mechanical linkage 207 which translates the movement in all directions by a uniform factor. The milling head in turn responsively translates, following the translation of the stylus, and "cuts," or mills, the desired isostress contoured surface into the die blank.

In some instances, in order to achieve highly accurate translation of the surface contour, it may be desirable to produce the profile of the master pattern by the aforedescribed pneumatic casting method with dimensional characteristics either larger or smaller than the desired profile of the die, depending, for example, on the particular characteristics of the flexible material employed in the pattern casting method, and in such case it is necessary to adjust the mechanical linkage 207 to obtain the desired size factor of enlargement or reduction.

In operation of an illustrative tracing milling machine of a type as shown in FIG. 9, both the stylus and the milling head of the machine trace across the width of the pattern and the die respectively, at a speed of 1½ inches per minute. After each widthwise pass, the trace is indexed 0.005 inch along the length for the succeeding pass. For sequential rough and fine finishing steps in the die forming operation, two "cutting" steps may suitably be employed, comprising a first "hogging" cut using a tapered milling head with a (larger) 0.010 inch tip radius, and a second "dressing" cut using a tapered milling head with a (smaller) 0.005 inch tip radius. All cutting tools are preferably constructed of high speed steel and may rotate, for example, at a speed of approximately 25,000 rpm.

Dies produced by the method discussed above in connection with the FIG. 9 apparatus may be of a "flat-bed" form which is suitable for use in stamping isostress contoured sheets, however, rolling dies can also be similarly produced. For example, a flat-bed master pattern may be fabricated of cured form-setting material in the manner of the previous examples. The isostress contour may then be transferred to a roll-form die blank by milling using a tracing milling machine in a manner similar to that previously described.

Although reference is made to the heat exchange elements of this invention as having an isostress contoured surface, it is to be understood that fabrication techniques prevent the imparting of an exact shear-free isostress contoured surface to a material having a finite thickness. Even the most flexible and elastic of materials does not perform precisely as an ideal soap bubble membrane. Inherently, thickness implies that some minimal shear and bending stresses will be present to cause deviations from the ideal countour. Such deviations occur, not only in the elastic material used to produce a die as in FIG. 2, but also in the wall materials subsequently formed from the die. Moreover, the weight of form-setting materials cast over a pneumatically-shaped film causes other deviations from an ideal contour. In addition, the elastic memory or spring-back characteristics of many thermally conductive wall materials hinders the attainment of a true shear-free isostress contour being impressed on their surfaces. Finally, the pressure difference $\Delta P$ imposed across the wall when in service produces deflections in the wall which cause departure from the as-formed contour. Whereas some deviations may counteract others, the net result will usually be a slight deviation in crest height H from the value assumed in the design of the surface. In isocompression applications, the net deviation of the height will usually result in a lower value of H than assumed in the design. Therefore to compensate for this deviation, a slightly higher value of H could be assumed for design purposes.

The equation for the isostress contour given previously does not take into account the deflection of the wall under service pressure, the spring-back of materials when formed with a die, or the deflections of molds due to the weight of form-setting materials. After an isostress wall has been formed, its performance can be checked by means of the foregoing equation. Actual measurement of H can be made with the wall under service pressure differential ΔP, and this value can be used in the equation to calculate the actual fiber stress S under load ΔP. It will then be known whether the maximum allowable stress is being exceeded and whether the deviations are tolerable or excessive.

If the actual stress with deviations is considered excessive, then the design of the wall can be refined and improved. For example, actual measurement of the surface will show the net deviation of H from the ideal dimension assumed in the original design. An adjustment in H can now be made such that when a new wall is formed using the adjusted dimension and is exposed to service pressure differential, the surface contour will match that of the ideal soap bubble membrane almost exactly. In this way, the design and production of the wall can be optimized. Thus the reference to an isostress contoured surface in this invention shall mean a substantially isostress contoured surface which allows for manufacturing deviations due principally to finite material thickness, material characteristics and fabrication techniques.

Figure 3:
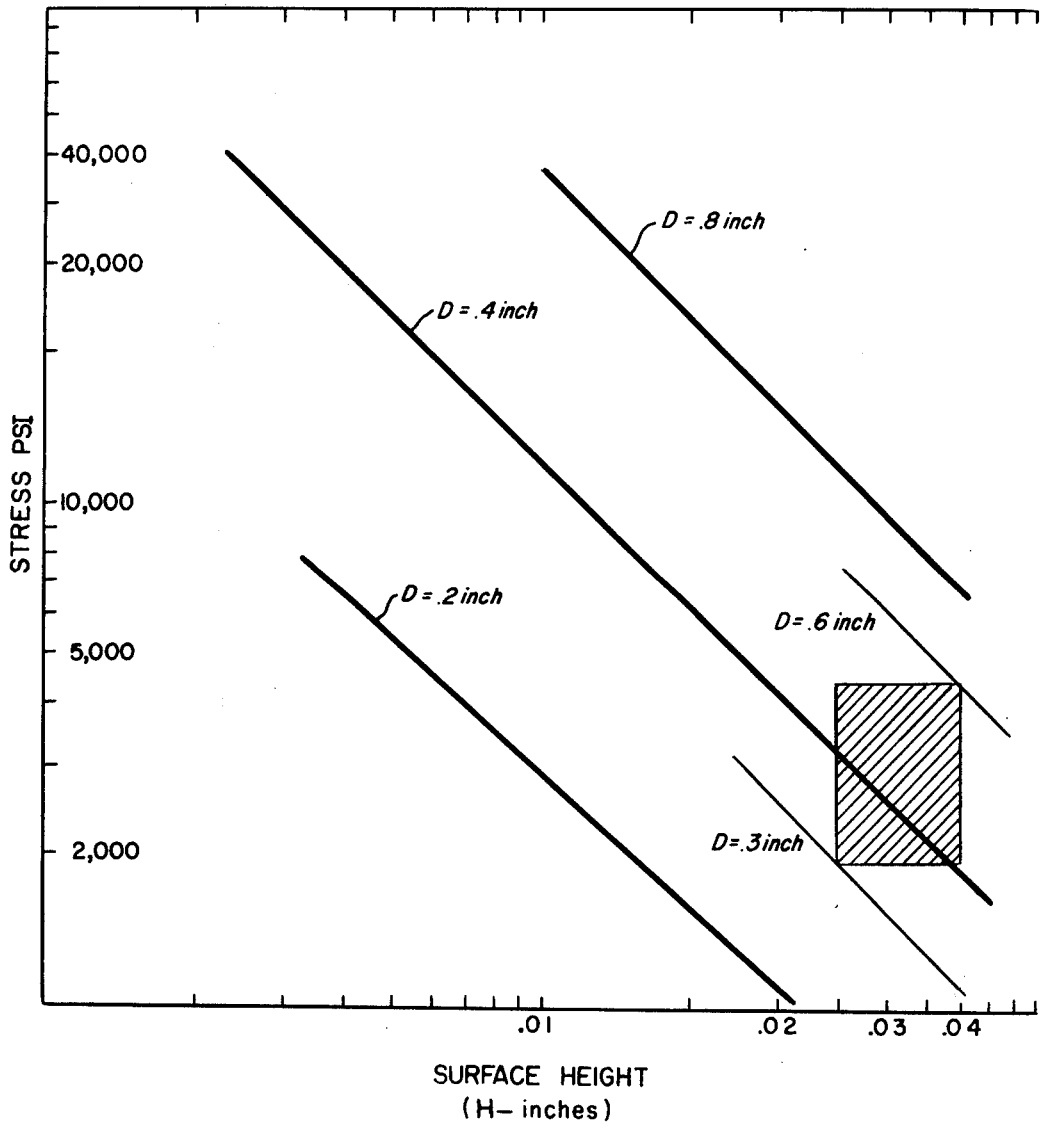
FIG. 3 — Log-Log graph of stress vs. surface height of an isostress contoured surface in a 0.007 inch thick aluminum sheet.
Figure 3A:
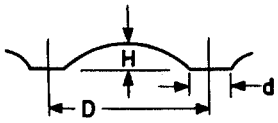
FIG. 3A — Isostress contoured surface.

For general heat exchange application, an isostress contoured surface, as illustrated in FIG. 3A, having a repeatable wall-supporting projection spacing D of between about 0.2 and about 2.5 inch; a D/*d* ratio between about 3 and about 10, a H/D ratio between about 0.05 and about 0.2 and a sheet or wall thickness between about 0.003 and about 0.25 inch will be quite suitable. As used above and as shown in FIGS. 1 and 3A, H equals the maximum height measured perpendicularly from a surface which contains the extremities of the wall-supporting projections (X-Y plane) to the innermost crest of the isostress surface of said element (along the Z axis), D equals the spacing between the center of the closest adjacent wall-supporting projections on the surface of said element, and *d* is the equivalent diameter of the projection defined by the ratio $4a/p$ whereby *a* equals the area of the load bearing segment (button) of the wall-supporting projection and *p* equals the perimeter of said load bearing segment. Where the configuration of the load bearing segment is a circle, *d* is equal to the diameter of such circle as shown in FIGS. 1 and 3A. The load bearing segment is shaped to mate in touching relationship with similar type load bearing segments on wall-supporting projections on a second heat exchange wall.

The limitation on the D spacing is imposed because spacing less than 0.2 inch results in very small dyraulic radii on the concave side of the isostress wall thereby being very susceptibel to fouling, i.e., trapping of foreign matter between adjacent walls, which if excessive, would clog the passages for one of the fluid mediums. A high external fluid pressure drop per unit length of fluid flow path would also result. Spacing D above 2.5 inches would result in a small heat exchange area per cubic foot of heat exchange volume thus resulting in excessive manufacturing cost and decreased efficiency. Also the ability for the material to withstand a differential pressure across its wall thickness would be decreased.

For D/*d* ratio of less than 3, the allowable differential pressure across the wall of a channelized heat exchange element would go up, but a very large percentage of the surface area would be lost for heat exchange purposes. On the other hand, a D/*d* ratio of greater than 10 would require tight manufacturing tolerance to insure the mating of bearing segments on abutting isostress walls and would also localize and concentrate the load at the contact point of the bearing segments and produce stresses sufficient to cause rupture or excessive deformation of the isostress walls.

A H/D ratio smaller than 0.05 would result in an isostress surface having very small hydraulic radii on the concave side steadily approaching almost a flat surface whereupon the advantages of the isostress contour would vanish. A heat exchanger composed of isostress channels with such a small H/D ratio would also be susceptible to fouling and have a high external fluid pressure drop per unit length of fluid flow path. For a H/D ratio of greater than 0.2, a small heat exchange area per cubic foot of heat exchange volume would result thereby resulting in excessive manufacturing cost and decreased efficiency.

A material thickness of less than 0.003 inch would be unsuitable due to local imperfections in the metal, produced during rolling or as a result of pitting (corrosion) or erosion. A material thickness to above 0.25 inch is not suited to this invention when employed within the imposed limits of D, H and *d*, because full or near-full utilization of the material strength implies extremely high pressure differentials. Embodiments wherein pressure forces are not balanced within the channels require massive external structures to absorb the loads, while force-balanced embodiments wherein wall-supporting projections are bonded together and loaded in tension would be characterized by severe stress concentration in such bonded areas.

To meet the specific heat exchange requirements for radiators of internal combustion engines, the allowable ranges expressed above should be narrowed to the following: a repeatable distance D between about 0.2 and about 0.6 inch, a D/*d* ratio of between about 3 and about 7; a H/D ratio of between about 0.05 and about 0.12; and a sheet or wall thickness between about 0.003 and about 0.02 inch. The preferred dimensions of an isostress contoured surface for automobile radiator applications are a repeatable D of about 0.4 inch, a height H of about 0.035 inch, a button dimension width *d* of about 0.09, a D/*d* ratio of about 4.8, a H/D ratio of about 0.08 and a sheet or wall thickness of about 0,008 inch.

As an illustration of this invention, the following example will be directed to the fabrication of an automobile radiator employing the primary-surface heat exchange elements described above. A log-log graph of stress versus height H (same as H in FIG. 1) of an isostress contoured surface having uniformly spaced wall-supporting projections in a square pattern on an aluminum sheet 0.007 inch thick was plotted as shown in FIG. 3 using the aid of a computer. Repeatable wall-supporting projection spacings D of 0.2, 0.4 and 0.8 inch, measured between the closest adjacent projected supports as illustrated in FIG. 3A, produced three parallel lines as shown in FIG. 3. Assuming a maximum allowable cross-sectional area stress for the aluminum sheet to be between about 2000 and 4500 psi in its intended operational mode, and a wall-supporting projection height H of between about 0.025 and about 0,04 inch, then an isostress contoured surface with a repeatable spacing of D between adjacent projected supports between about 0.3 and about 0.6 inch would be admirably suited for heat exchange applications such as for automobile radiators. These ranges of D spacing and H projection heights, shown cross-hatched on the graph of FIG. 3, are representative of aluminum base alloys such as type 1100 and 3003 stressed to a relatively low level, i.e., with a high factor of safety. Based upon such stress levels, the cross-hatched area may serve as a guide for producing a multiple-curved isostress contoured surface in a thin wall aluminum sheet which upon being fabricated into channel structures as described above will yield an effective and efficient heat transfer radiator for the internal combustion engine. If stronger material and/or lower factors of safety were used then the allowable stress ranges would move upward. Thus the allowable D-dimension range would increase for the same limits of the H-dimension.

Figure 4:
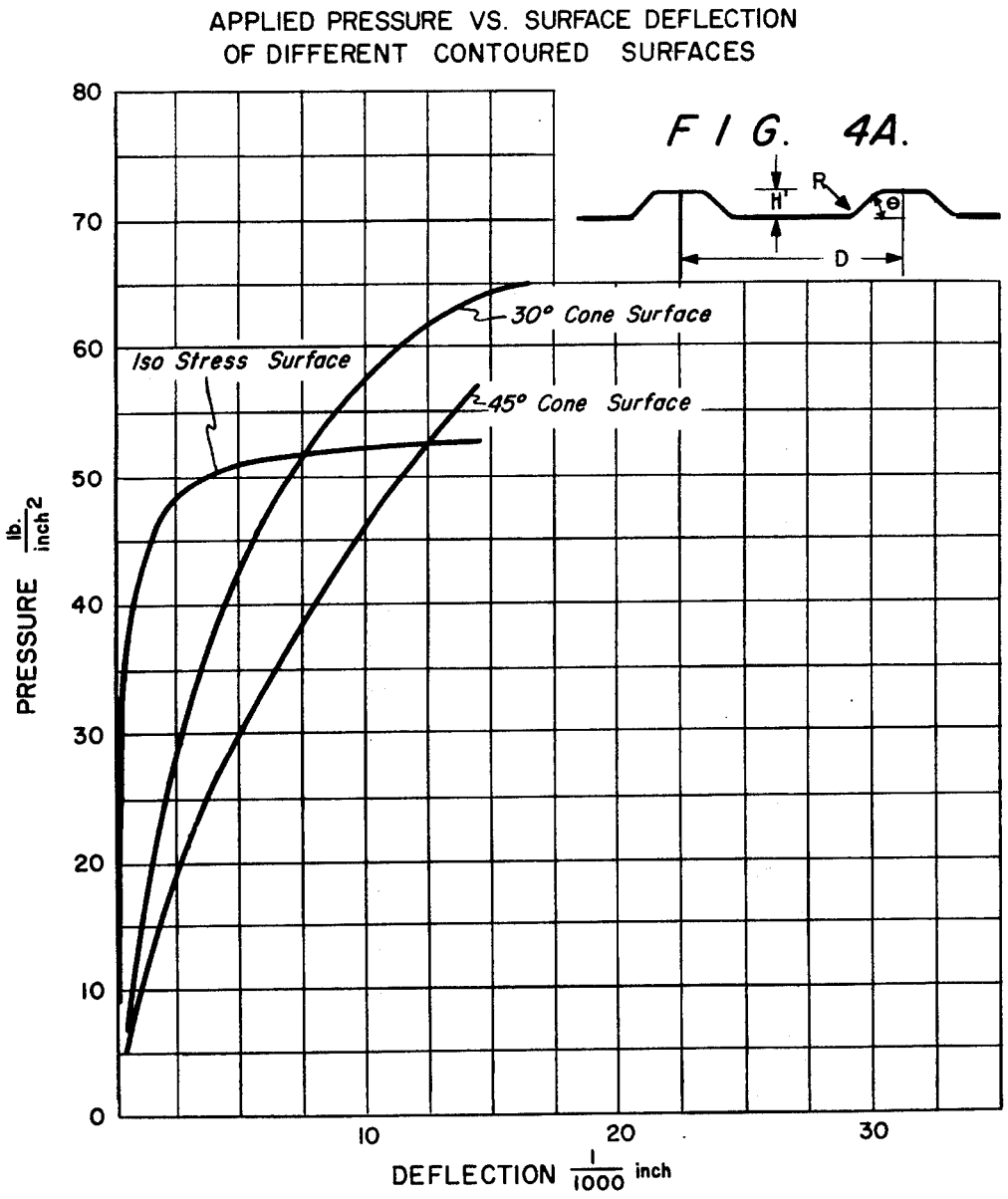
FIG. 4 — A graph of applied pressure vs. surface deflection for various aluminum contoured surfaces.

The allowable deviation from a theoretical isostress contoured surface for automobile radiator applications using 0.008 inch thick aliminum sheet material was investigaged by plotting curves of applied pressure (lb/sq. inch) versus surface deflection (inches). An isostress contoured surface having 16 wall-supporting projections arranged in a square pattern was stamped on the aluminum sheet. The D spacing between the projected supports was 0.4 inch and the height H was 0.035 inch as shown in FIG. 3A. Pressure was applied to the isostress contoured surface of the aluminum sheet on the convex side of the curvature such as to place the material under compression and the deflection at the center of the diagonals of the square pattern was measured. This data is shown plotted on the graph of FIG. 4. Truncated-conical projections or indentations, as shown in FIG. 4A, with cone angles Θ of 30° or 45°, heights H′ of 0.035 inch, were likewise stamped onto identical aluminum sheets in the same square pattern and then subjected to the same type pressure versus deflection testing. The 30° cone surface is an embodiment of the above-identified copending application. The data obtained using both the 30° cone and 45° cone projected sheets is also shown plotted as curves on the graph of FIG. 4. The cone angle Θ is the acute interior angle measured between the horizontal undeformed surface of the wall adjacent the projected indentation and the substantially straight segment along the sloped side of the conical indentation.

Deflections of the crest of the surface tending to flatten the wall are objectionable and should be minimized even though such deflections may be safely below the buckling point of the material. As noted previously, deflections represent deviations from the ideal soap bubble membrane contour. If the deflections are excessive, the ideal contour cannot be closely approached under service pressure differentials even though allowances are made in the design. Moreover the material is usually stressed in bending and shear as it deflects, and when deflections are excessive the material may experience stresses approaching the yield point in localized areas. If such deflections are imposed repeatedly in service, the material may be fatigued and crack after a relatively short service life. Additionally, deflections reduce the available space between the heat exchange walls in the lower pressure passages, and result either in higher fluid pressure drop or in reduced rate of fluid flow. With reference to FIG. 4, it is seen that the isostress contoured wall used in the tests exhibited virtually no deflection at the crest for pressure differentials as high as 35 psi. In contrast, the 45° cone surface deflected severely at low pressure differentials.

In the foregoing tests of the isostress contoured surface, and the 30° and 45° truncated-conical surfaces, the stress in the material was also measured directly by means of strain gauges at 30 psi differential pressure. The stress was measured on the diagonal at the point where the inclined surface of the conical identations met the flat undeformed segment of the material, i.e., in the radius R arc. The following data was taken:

| Surface | Stress, psi |
|---|---|
| Isostress contour | 13,800 |
| 30° cone | 18,400 |
| 45° cone | 42,000 |

The data shows the increase in stress resulting from use of the 30° and 45° cone surfaces over the isostress contour surface. It should be noted that in order to achieve the isostress wall of this invention, it is essential that all the surface area exclusive of the wall-bearing supports be unrestricted so as to be free to deflect and therefore be devoid of local mechanical loading. It has been found that when the crest of the contour of adjacent pairs of isostress channels are bonded securely together, then the bonded contacts between channel pairs provide a portion of the support for the walls against pneumatic pressure force and when the surface of such a crest-bonded arrangement is pressurized pneumatically on its convex curvature, the localized mechanical constraint at the center or crest of the curved surface produces extreme shear and bending stresses which result in destruction of the isostress walls at low pneumatic loading.

Once the dimensions of, and the dimensional relationship between, the desired isostress contoured segments and the wall-supporting projections of a heat exchange element are determined, a die can be prepared as described above. The die can then be used in conventional type apparatus to impart the desired isostress contour, as described above, onto a thin-walled thermally conductive sheet, such as aluminum. For radiator applications, a rectangular aluminum sheet can be stamped or the like with an isostress contoured die. If the sheet is to be folded, then the central folding area shall be left free of wall-supporting projections. The sheet, which may have any desired thickness, as specified above, although about a 0.008 inch thick sheet is preferable, can then be longitudinally folded at the center forming a flattened tube-like configuration with the wall-supporting projections facing inward and outward. Instead of preparing one large sheet and folding it, two sheets may be prepared and formed appropriately at the longitudinal edges for bonding and then spaced apart by suitable means to form a flattened tube-like configuration. If desired, the longitudinal edges of the sheets could be flared a specific amount so that when said longitudinal edges of two sheets are juxtaposed in touching relationship, they will provide the desired spacing within the channel. The edges of the sheets can be "potted" as with epoxy resin to seal the sheets leak-tightly together to form tube-like configurations, an array of which can be sealed leak-tightly into a header to form a radiator assembly.

As shown in FIGS. 5, 5A and 5B, flattened tube-like heat exchange elements 1 can be air-tightly sealed along their edges 2–3 using a lock-seam joint filled with an adhesive 14, such as a suitable epoxy type adhesive.

The heat exchange elements 1 having an isostress contoured surface 4 with spaced apart wall-supporting projections 5, can be superimposed with the surface extremities 17 (buttons) in touching relationship to form a multiple layer heat exchanger. As shown in FIG. 5B, the touching projected buttons 17 provide passages 15 between adjacent heat exchange elements 1 defined by the isostress contoured surfaces 4 of the adjacent elements 1, and in addition, the contacting buttons 17 act as a restraint against internal pressure in the heat exchange elements 1. The projected button 5' could offset or non-symmetrically disposed on opposite sides of each element 1', as shown in FIG. 5C, thereby altering the passage area of element 1'. The ends 6 of element 1 are slighty depressed, if necessary, to provide a clearance for the teeth 7 of comb-shaped members 8. Members 8 retain elements 1 in proper relationship and provide an outer plate segment 9 adaptable for securing header 10 thereto. In addition, members 8 must also produce a leak-tight seal to header 10 and to the channel elements 1 so that in the operational mode a fluid fed through the elements 1 via the header 10 will not leak into the space between adjacent elements 1. As shown, header 10 can be secured to members 8 by using an adhesive type joint arrangement. A suitable resin for use in adhesive type joints for aluminum is Resin Type EA-914, manufactured by Hysol Division of Dexter Corporation, California. However, this resin must be used in conjunction with an Alodine process for pretreating the surfaces to be bonded. An Alodine pretreating process would basically consist of the following steps:

a. soaking and rubbing the surfaces to be bonded in acetone to degrease;

b. immersing the surfaces in weak $H_3PO_4$ acid for 10–15 seconds at room temperature;

c. washing the surfaces in water;

d. immersing the surfaces in Alodine No. 1200 at room temperature for 5 to 20 minutes (Alodine No. 1200 is manufactured by Amchem Products, Inc., Freemont, California, and contains acidic chromates and fluorides);

e. washing the surfaces with water; and f. drying the surfaces.

Figure 7:
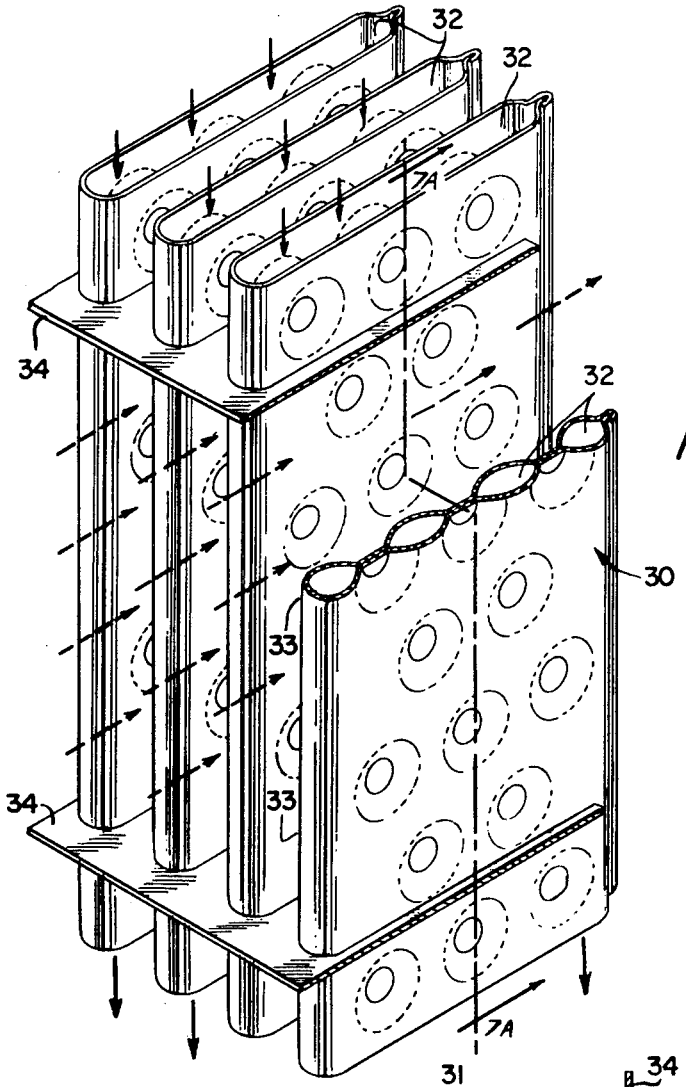
FIG. 7 — Isometric view of an array of isostress channels with inwardly projected buttons.
Figure 7A:
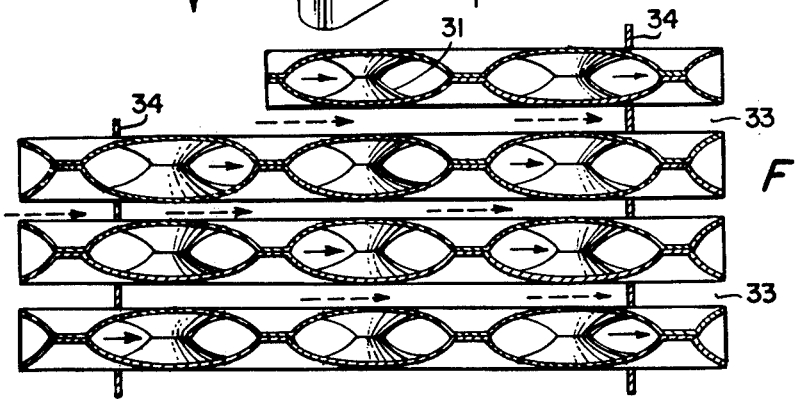
FIG. 7A — Sectional side view of channels in FIG. 7 taken along line 7A—7A.

The dried surfaces can thereafter be bonded with the resin preferably within about a 4 (four) hour period. Elements 1 can then be retained together by employing a tension-type channel 12 which can be secured to either members 8 and/or to a separate structure member 13. Channel 12 must also be designed rigidly with sufficient cross-sectional moment of inertia to absorb a bending load and to permit small expansion of elements 1. Members 8 and/or 13 can further be secured to a frame of the automobile for better support. To better illustrate the dual set of passages of an array of elements of this invention, FIGS. 6, 6A and 6B show an array of elements 21 with outwardly protruding wall supports 22. Passages 23 in elements 21 define one set of confined passages independent of and separate from a second set of passages 24 formed between adjacent elements 21. One fluid, shown as solid line arrows, can be fed through passages 23 in elements 21 while simultaneously a second cooler fluid, shown as broken line arrows, can be fed through passages 24 to effectively cause a transfer of heat from the hotter fluid to the cooler fluid without having them intermixed. For this type isocompression embodiment, a rigid frame or support similar to support 12 of FIG. 5 is required so as to constrain the stack of elements 21 along the sides. FIGS. 7 and 7A illustrate a similar array of elements 30 except that the wall-supporting projections 31 are inwardly projected. Passsages 32 within elements 30 are independent of and separate from passage 33 formed between adjacent elements 30. One fluid, shown as solid line arrows, can be fed through passages 32 while simultaneously a second cooler fluid, shown as broken line arrows, can be fed through passages 33 to effectively cause a transfer of heat from the hotter fluid to the cooler fluid without having them intermixed. For this type of element arrangement, spacers 34 are required to space the elements 30 sufficiently apart so as to define passages 33. It is to be understood that the spacer 34 could be similar to the comb-like structure 8 as shown in FIG. 5, which in turn could be coupled directly to a header similar to header 10 illustrated also in FIG. 5.

In the operational mode of an automobile radiator, as shown in FIG. 5, hot water from an internal combustion engine is fed through elements 1 while cool air is circulated through the passages 15 formed between adjacent elements 1. To increase the efficiency of the heat exchange elements 1, one or both of the edges 2 and 3 may be extended to provide a secondary surface heat dissipating fin 16 as shown in Fig. 5D. The fin, which could also be added to the elements by conventional securing means, can be provided with dimplings to promote turbulence, or provided with slots or assume any other desirable geometric configuration which would enhance the performance of the heat exchange elements. Also side bars could be used to separate the elements as shown in U.S. Pat. No. 3,291,206 or edge ribs, as shown in U.S. Pat. No. 3,106,242.

Although the above illustration was directed to automobile radiators, the primary-surface heat exchange element of this invention can be employed in any type heat exchanger wherein a heat transfer between a heated medium and a coolant medium is to be accomplished without an intermixing of the media occurring. The design flexibility of the primary-surface heat exchange elements of this invention makes them admirably suited for complex type heat exchanger applications including pre-heaters for gas turbines and low grade heat rejectors for atomic power plants.

As used herein, Mylar is a tradename of E. I. DuPont Company and Alodine is a tradename of Amchem Products, Inc.

What is claimed is:

1. A method for making a die for use in fabricating isostress contoured sheets wherein said die has an isostress contoured surface with spaced apart unidirectional projections comprising the steps of:

a. fabricating a block having on its surface multiple vertically projected supports and upwardly extending sides around the edges of said block so as to provide a cavity which contains said vertical supports, said supports forming a pattern and being dimensionally sized to correlate to the pattern and size of the wall-supporting projections desired in an isostress contoured surface;

b. tensionally securing a flexible material across the top of said cavity so that it contacts, and is supported by, said vertically projected supports;

c. pneumatically deforming the flexible material so as to force the unsupported portion of said flexible material into the cavity while the vertically projected supports prevent deflection of the supported portion of said flexible material contacting said supports thereby causing the flexible material to assume an isostress contour having substantially uniformly disposed unidirectional projections;

d. depositing and curing a form setting material against the pneumatically deformed flexible material;

e. discontinuing the pneumatic deformation; and f. removing the cured material having an isostress contoured surface with spaced apart unidirectional projections.

2. A method according to claim 1 wherein said form setting material is selected from the group consisting of epoxy resins, thermoplastics, concrete and cement.

3. A method according to claim 1 wherein said form setting material comprises an epoxy resin admixed with a metal powder selected from the group consisting of steel, aluminum, carbide and bronze.

4. A method according to claim 1 wherein said cured material of step (f) is provided as said die.

5. A method according to claim 1 wherein said form setting material is deposited and cured on the top of said flexible material.

6. A method according to claim 1 comprising the steps of: filling said cavity completely with said form setting material prior to step (b), tensionally securing said flexible material across the top of said cavity in said step (b), such that there are no voids in the form setting material covered by said flexible material; removing a part of said form setting material from said cavity in the pneumatic deforming step (c); and terminating the removal of said form setting material when said flexible material has assumed said isostress contour, whereby said form setting material is deposited and cured against the underside of said flexible material in step (d).

7. A method according to claim 1 wherein said flexible material is a rubber material.

8. A method according to claim 1 comprising casting a corresponding mating die over the removed cured material of step (f), to provide a male and female die pair for stamping isostress contoured sheets.

9. A method according to claim 1 comprising impressing the isostress contoured surface of the removed cured material of step (f) in a mold and casting a metal in said mold to form said die.

10. A method according to claim 1 for making a metal die comprising the steps of:

a. providing a tracing milling machine having a tracing stylus adapted for traversing movement and mechanically linked to a milling head for translation of said milling head in response to said trsaversing movement of said tracing stylus;

b. providing a metal die blank and fixedly proximately mounting same beneath said milling head, and fixedly proximately mounting said removed cured material of step (f) beneath said tracing stylus;

c. moving said tracing stylus continuously traversingly across the fixedly mounted cured material so as to trace said isostress contoured surface thereof;

d. transmitting the traversing movement of said stylus across said fixedly mounted cured material to said milling head through said mechanical linkage, thereby translating said milling head in response to the translation of said stylus, and milling an isostress contoured surface into said metal die blank to form said metal die.

11. A method according to claim 10 wherein said milling is conducted in sequential steps comprising rough finishing milling with a larger diameter milling head and fine finishing milling with a smaller diameter milling head.

12. A method for making a die for use in fabricating isostress contoured sheets wherein said die has an isostress contoured surface with spaced apart unidirectional projections comprising the steps of:

a. fabricating a block having on its surface multiple vertically projected supports and upwardly extending sides around the edges of said block so as to provide a cavity which contains said vertical supports, said supports forming a pattern and being dimensionally sized to correlate to the pattern and size of the wall-supporting projections desired in an isostress contoured surface;

b. tensionally securing a flexible material across the top of said cavity so that it contacts, and is supported by, said vertically projectd supports;

c. pneumatically deforming the flexible material so as to force the unsupported portion of said flexible material into the cavity while the vertically projected supports prevent deflection of the supported portion of said flexible material contacting said supports thereby causing the flexible material to assume an isostress contour having substantially uniformly disposed unidirectional projections;

d. depositing and curing a form setting material against the pneumatically deformed flexible material;

e. discontinuing the pneumatic deformation; and f. removing the cured material having an isostress contoured surface with spaced apart unidirectional projections;

g. providing a tracing milling machine having a tracing stylus adapted for traversing movement and mechanically linked to a milling head for translation of said milling head in response to said traversing movement of said tracing stylus;

h. providing a metal die blank and fixedly proximately mounting same beneath said milling head, and fixedly proximately mounting said removed cured material of step (f) beneath said tracing stylus;

i. moving said tracing stylus continuously traversingly across the fixedly mounted cured material so as to trace said isostress contoured surface thereof;

j. transmitting the traversing movement of said stylus across said fixedly mounted cured material to said milling head through said mechanical linkage, thereby translating said milling head in response to the translation of said stylus, and milling an isostress contoured surface into said metal die blank to form said metal die.

* * * * *